US006757400B1

(12) United States Patent
Cheng

(10) Patent No.: US 6,757,400 B1
(45) Date of Patent: Jun. 29, 2004

(54) MICROPHONE STRUCTURE PROVIDED WITH MEANS TO ENGAGE MUSICAL INSTRUMENT

(75) Inventor: Ming-Chung Cheng, Taichung (TW)

(73) Assignee: TAKY Electronics Co., Ltd., Ta-Li (TW)

( * ) Notice: Subject to any disclaimer, the term of this patent is extended or adjusted under 35 U.S.C. 154(b) by 0 days.

(21) Appl. No.: 10/173,150

(22) Filed: Jun. 18, 2002

(51) Int. Cl.[7] ..... H04R 25/00
(52) U.S. Cl. ..... 381/361; 381/365; 381/366
(58) Field of Search ..... 381/361, 362, 381/363, 365, 366, 355, 91, 122

(56) References Cited

U.S. PATENT DOCUMENTS 3,665,490 A * 5/1972 Oskar ..... 381/365
4,811,405 A * 3/1989 Peiker ..... 381/366
6,424,723 B1 * 7/2002 Jing ..... 381/365

* cited by examiner

*Primary Examiner*—Huyen Le
(74) *Attorney, Agent, or Firm*—Bacon & Thomas, PLLC

(57) ABSTRACT

A microphone structure has a base which is provided with a locating hole for locating a microphone, a receiving slot in which a threaded rod is rotatably received, a fixed clamp piece extending from the outer wall of a portion in proximity of the upper end of the base, and a movable clamp piece provided with threaded hole and movably located under the fixed clamp piece such that the threaded hole of the movable clamp piece is engaged with the threaded rod. The threaded rod is turned to drive the movable clamp piece to move up or down so as to adjust the distance between the movable clamp piece and the fixed clamp piece.

5 Claims, 10 Drawing Sheets

Fig・1
PRIOR ART

Fig・2
PRIOR ART

Fig・3
PRIOR ART

Fig・4
PRIOR ART

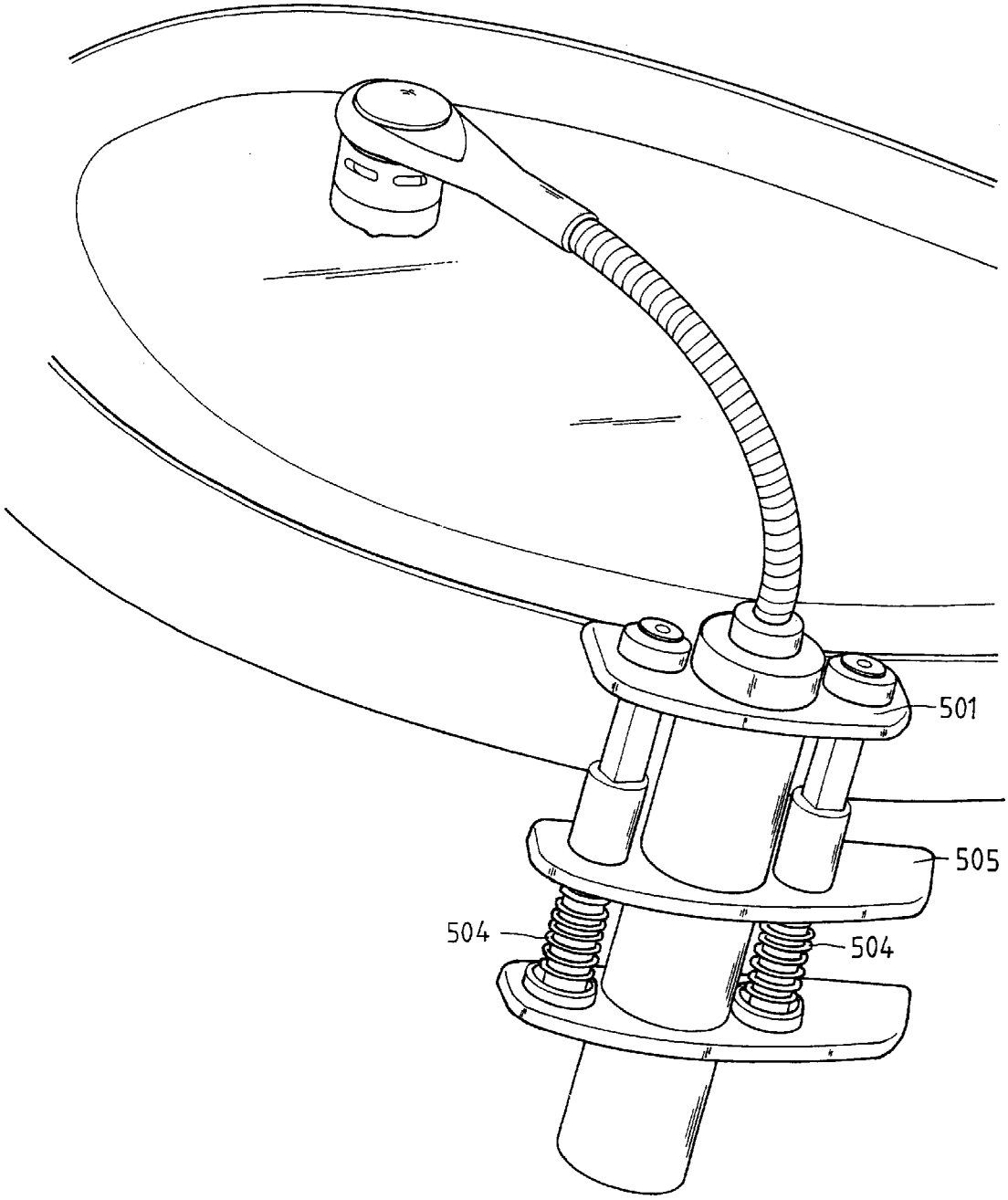
Fig • 6
PRIOR ART

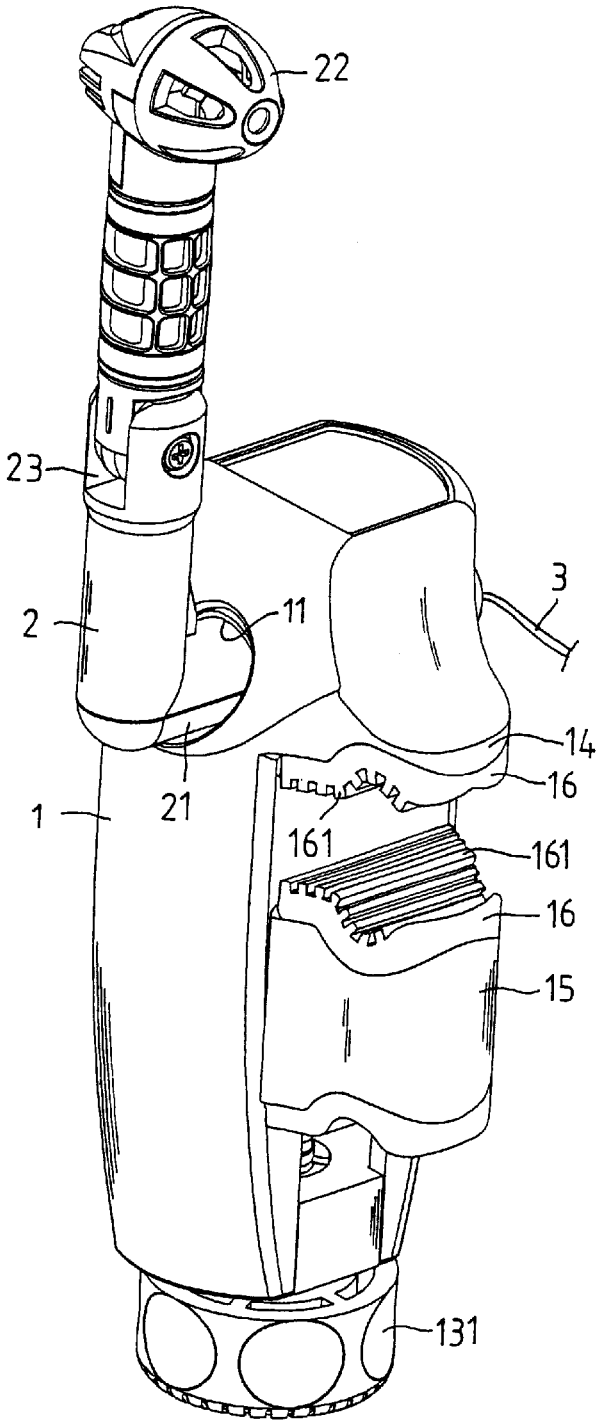
Fig • 7

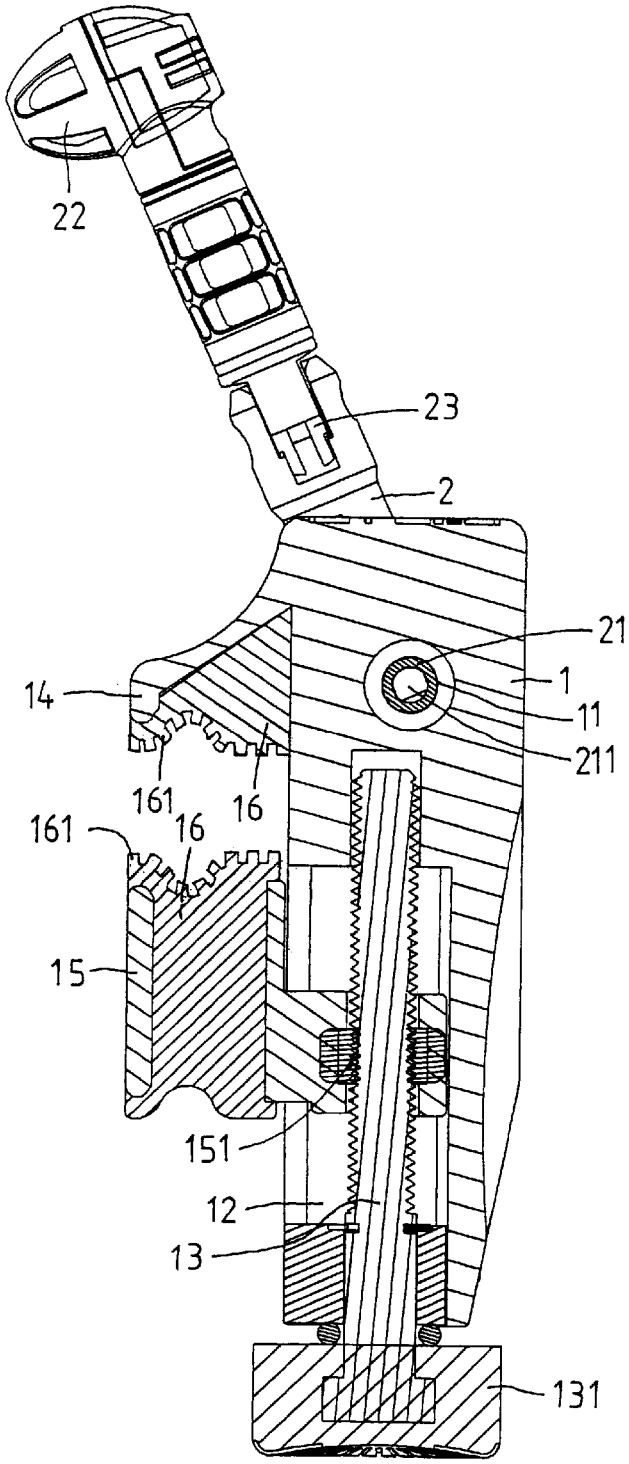
Fig・8

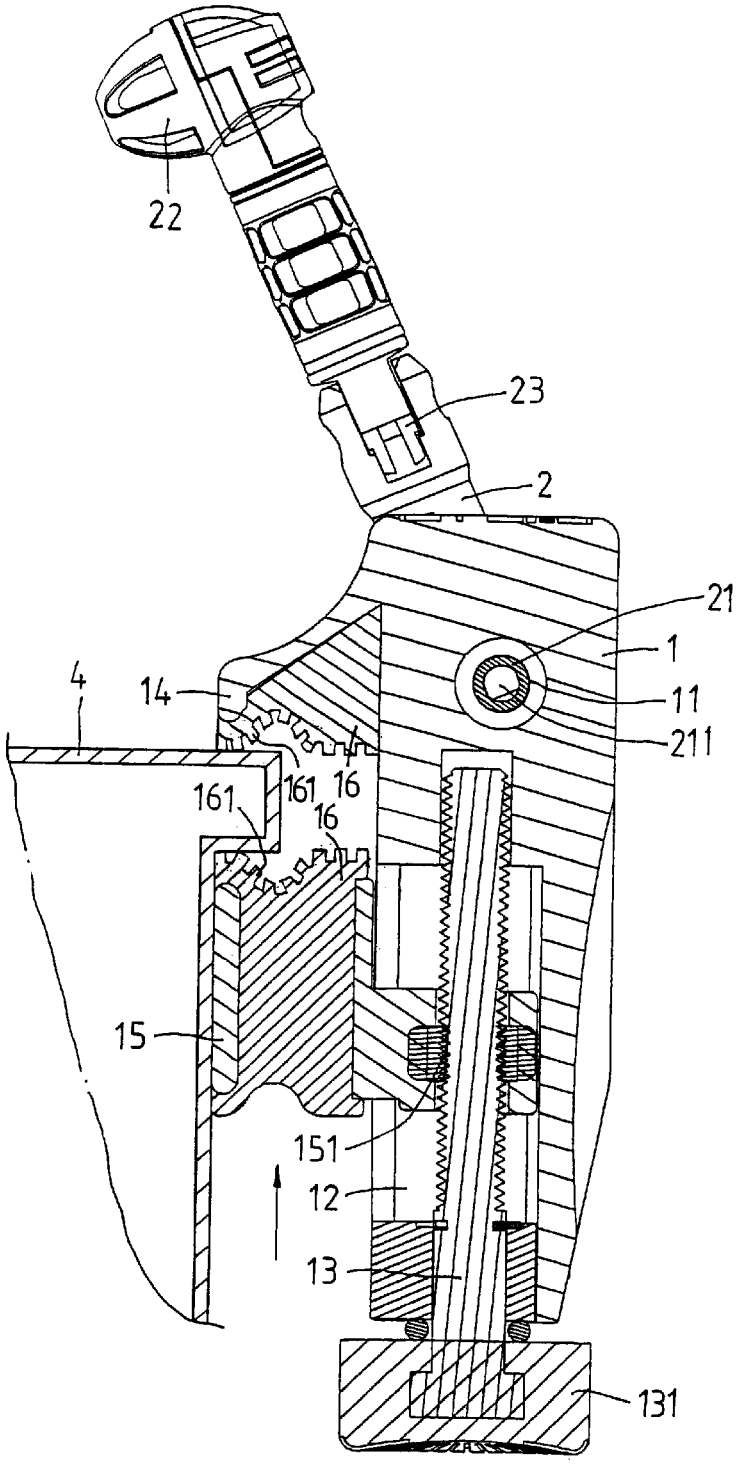
Fig・9

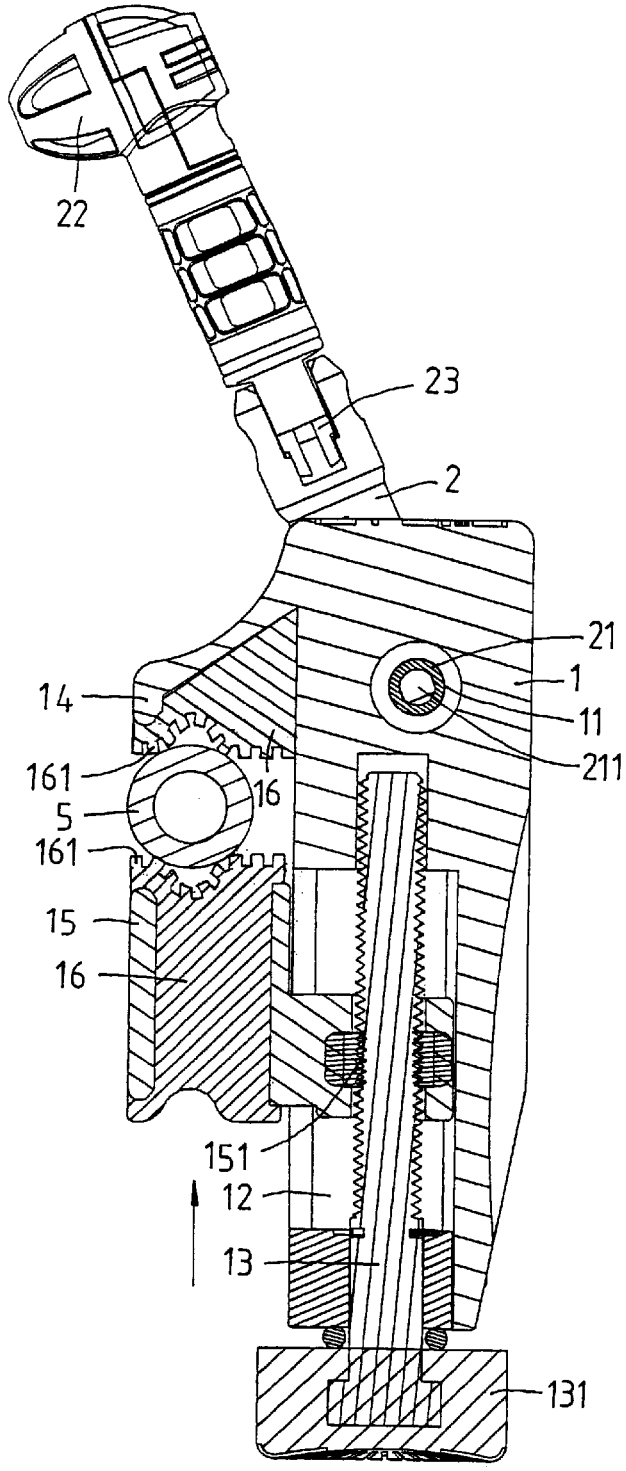
Fig・10

MICROPHONE STRUCTURE PROVIDED WITH MEANS TO ENGAGE MUSICAL INSTRUMENT

FIELD OF THE INVENTION

The present invention relates generally to a microphone structure, and more particularly to a structure for holding a microphone and attaching the microphone to a percussion instrument or wind instrument. The structure is provided with means to absorb shock.

BACKGROUND OF THE INVENTION

The microphone is generally mounted on a floor stand, which is located appropriately in the concert hall. The floor stand is heavy and must be adjusted in height and angle so as to maximize the effect of the microphone. However, the use of the microphone floor stand is not effective, especially in a concert in which a number of musicians are seated in the designated locations. A remedial measure is to provide a microphone structure by which the microphone is attached to a musical instrument, thereby resulting in elimination of the microphone floor stand.

As shown in FIGS. 1 and 2, a prior art microphone structure 10 comprises two clamping pieces 101 for attaching a microphone 20 to the bell rim of a brass wind instrument. The two clamping pieces 101 is provided therebetween with a gripping space in which the bell rim of the brass wind instrument is received. However, the gripping space is generally too small to accommodate a wood instrument or percussion instrument.

As shown in FIGS. 3 and 4, another prior art microphone structure comprises a seat 30 and a microphone 40. The microphone 40 is attached to the seat 30 such that the microphone 40 can be adjusted in position, and that the microphone 40 is attached to a percussion instrument, such as a drum, by the seat 30. The seat 30 is an integrally-made structure incapable of locating the microphone 40 securely in place at a predetermined portion of the drum, especially at the time when the drum is struck. The gripping space of the seat 30 is fixed and can not be therefore adjusted to accommodate the wind instrument.

As shown in FIGS. 5 and 6, a prior art microphone structure comprises a clamp seat 50 which is formed of a seat body 501, an upper clamp piece 502, a lower clamp pieces 503, two spring 504, and a movable piece 505. Before fastening the microphone to a musical instrument, the movable piece 505 is pressed downwards to compress the springs 504 so as to widen the gap between the upper clamp piece 502 and the lower clamp piece 503 to accommodate the side edge of the musical instrument. As the movable piece 505 is relieved of the pressure exerting thereon, the movable piece 505 is forced by the spring force of the springs 504 to move upward, thereby resulting in the clamping of the side edge of the musical instrument by the upper clamp piece 502 and the lower clamp piece 503. The compression springs 504 are susceptible to metal fatigue after the prolonged use of the microphone structure. As a result, the microphone can not be securely held in place by the musical instrument.

SUMMARY OF THE INVENTION

The primary objective of the present invention is to provided a microphone structure comprising a fixed clamp piece, a movable clamp piece, and a threaded rod by which the movable clamp piece is moved up and down so as to adjust the gap between the fixed clamp piece and the movable clamp piece to accommodate the bell rim of a wind instrument or the edge of a percussion instrument. The fixed is clamp piece and the movable clamp piece are provided with a shock-absorbing pad, which comes in contact with the bell rim of the wind instrument or the edge of the percussion instrument at the time when the microphone structure is engaged with the musical instruments. The contact surface of the shock-absorbing pad is provided with a serrated surface to give an added holding effect to the fixed clamp piece and the movable clamp piece.

The threaded rod is disposed in a receiving slot of a base such that the threaded rod is meshed with a threaded hole of the movable clamp piece, and that one end of the threaded rod is jutted out of the receiving slot of the base. When the one end of the threaded rod is turned, the movable clamp piece is actuated to move upward or downward so as to adjust the distance between the movable clamp piece and the fixed clamp piece. The base is provided with a locating hole for locating a microphone.

The features and the advantages of the present invention will be more readily understood upon a thoughtful deliberation of the following detailed description of a preferred embodiment of the present invention with reference to the accompanying drawings.

BRIEF DESCRIPTION OF THE DRAWINGS

FIGS. 5 and 6 are schematic views of still another prior art microphone structure.

FIG. 7 shows a perspective view of the preferred embodiment of the present invention.

FIG. 8 shows longitudinal sectional view of the preferred embodiment of the present invention.

FIG. 9 shows a sectional schematic view of the preferred embodiment of the present invention being interlocked with a percussion instrument.

FIG. 10 shows a sectional schematic view of the preferred embodiment of the present invention being interlocked with a wind instrument.

DETAILED DESCRIPTION OF THE PREFERRED EMBODIMENT

Figure 1:
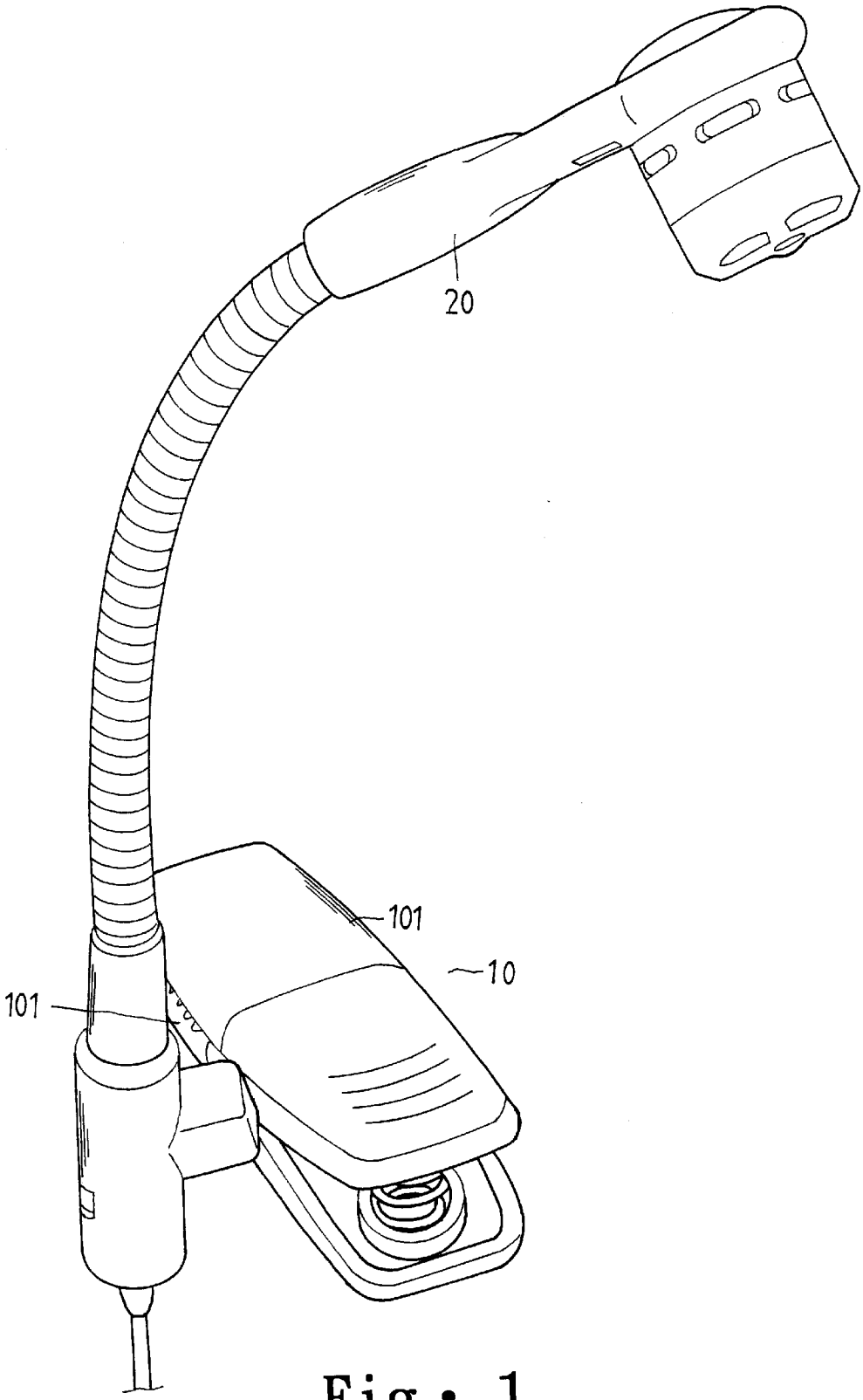
FIGS. 1 and 2 are schematic views of a prior art microphone structure.
Figure 2:
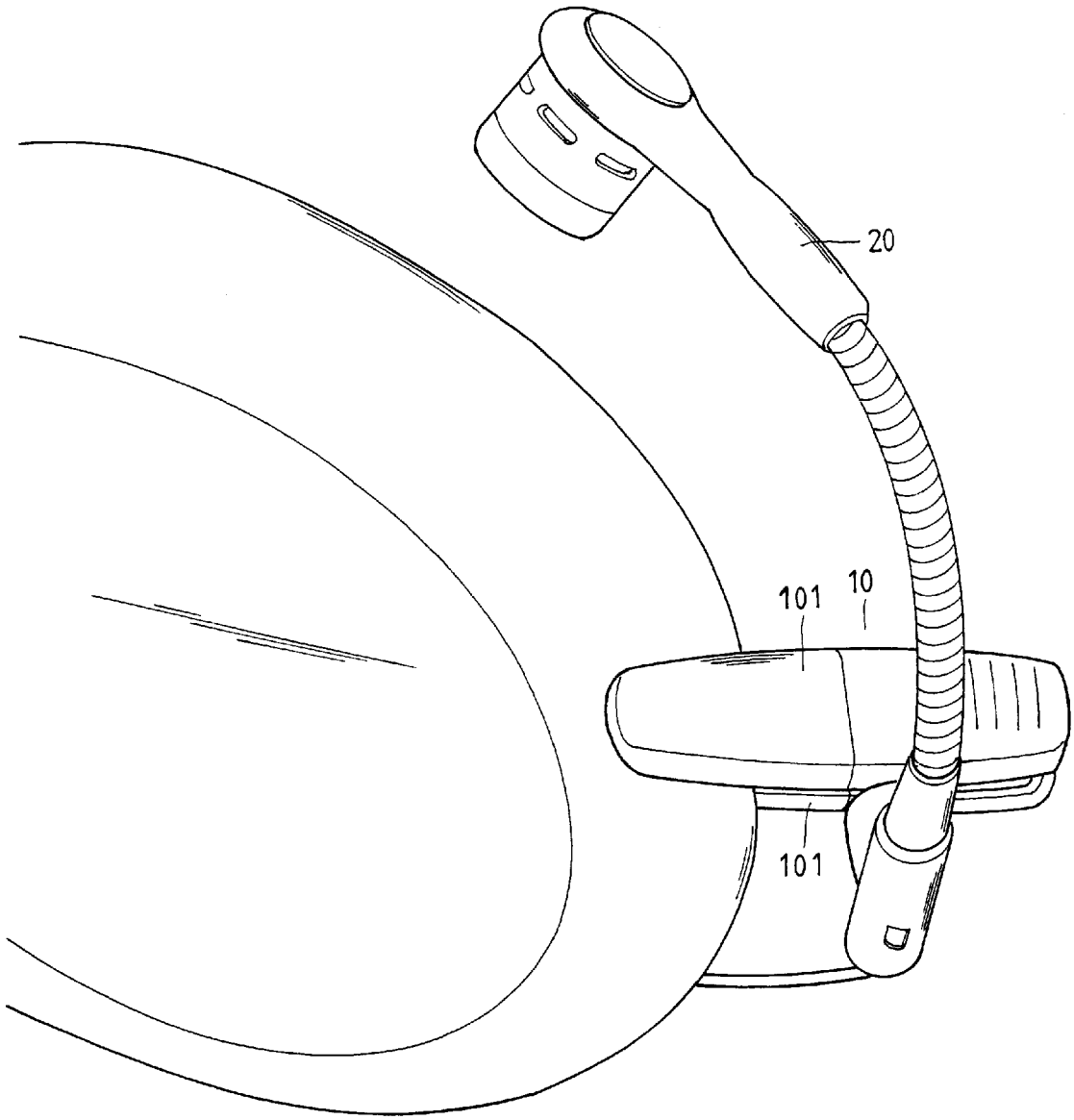
Figure 3:
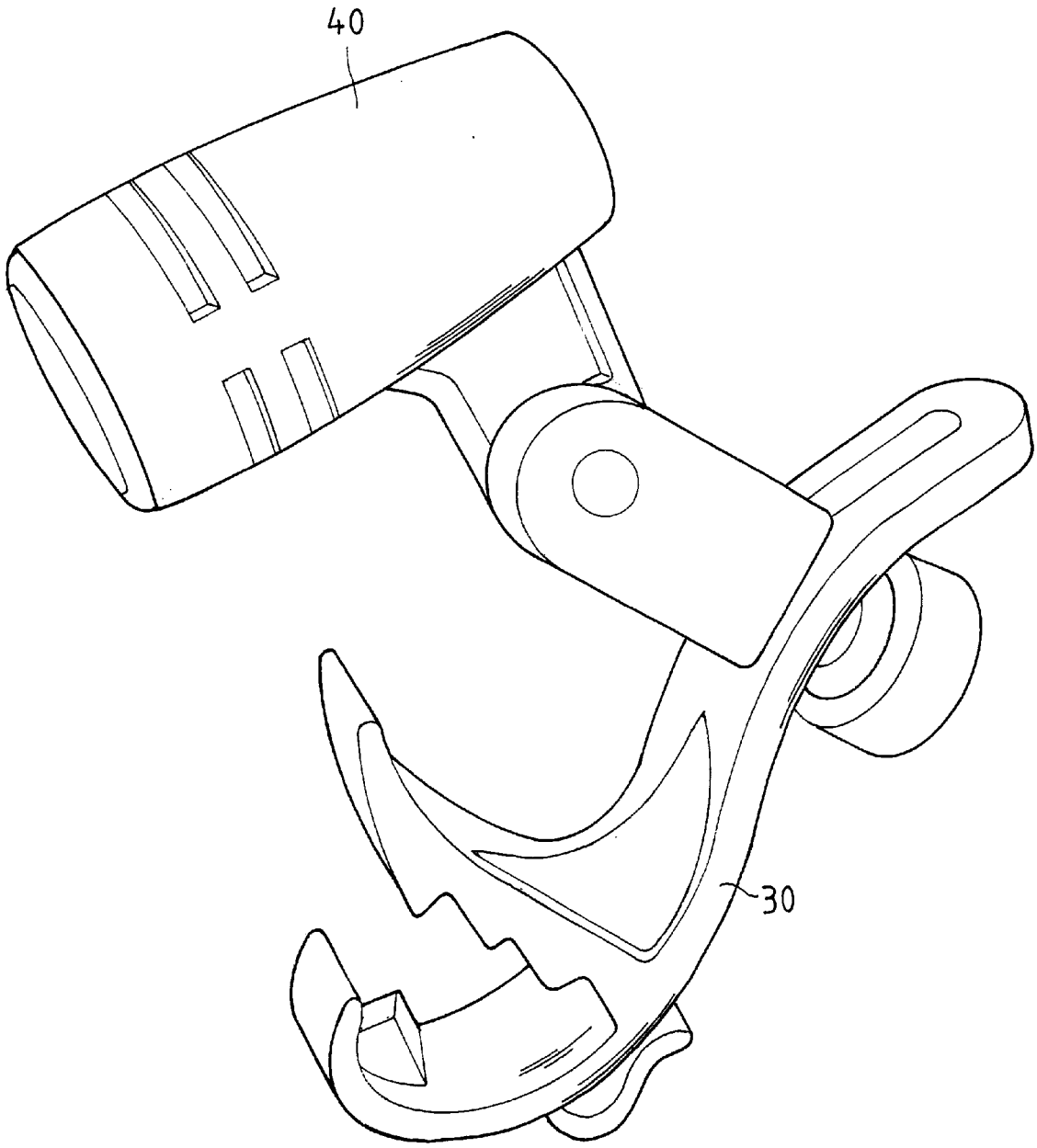
FIGS. 3 and 4 are schematic views of another prior art microphone structure.
Figure 4:
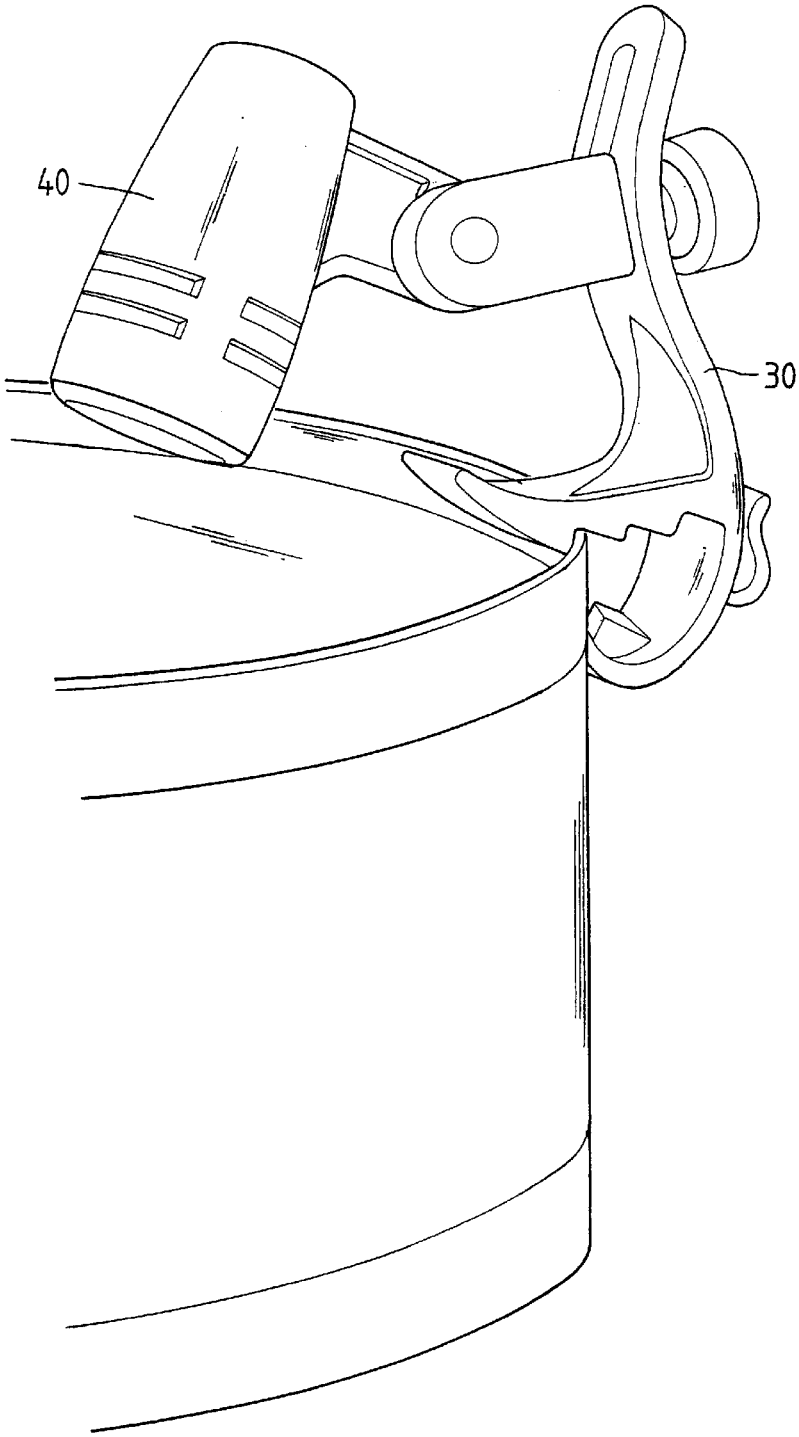
Figure 5:
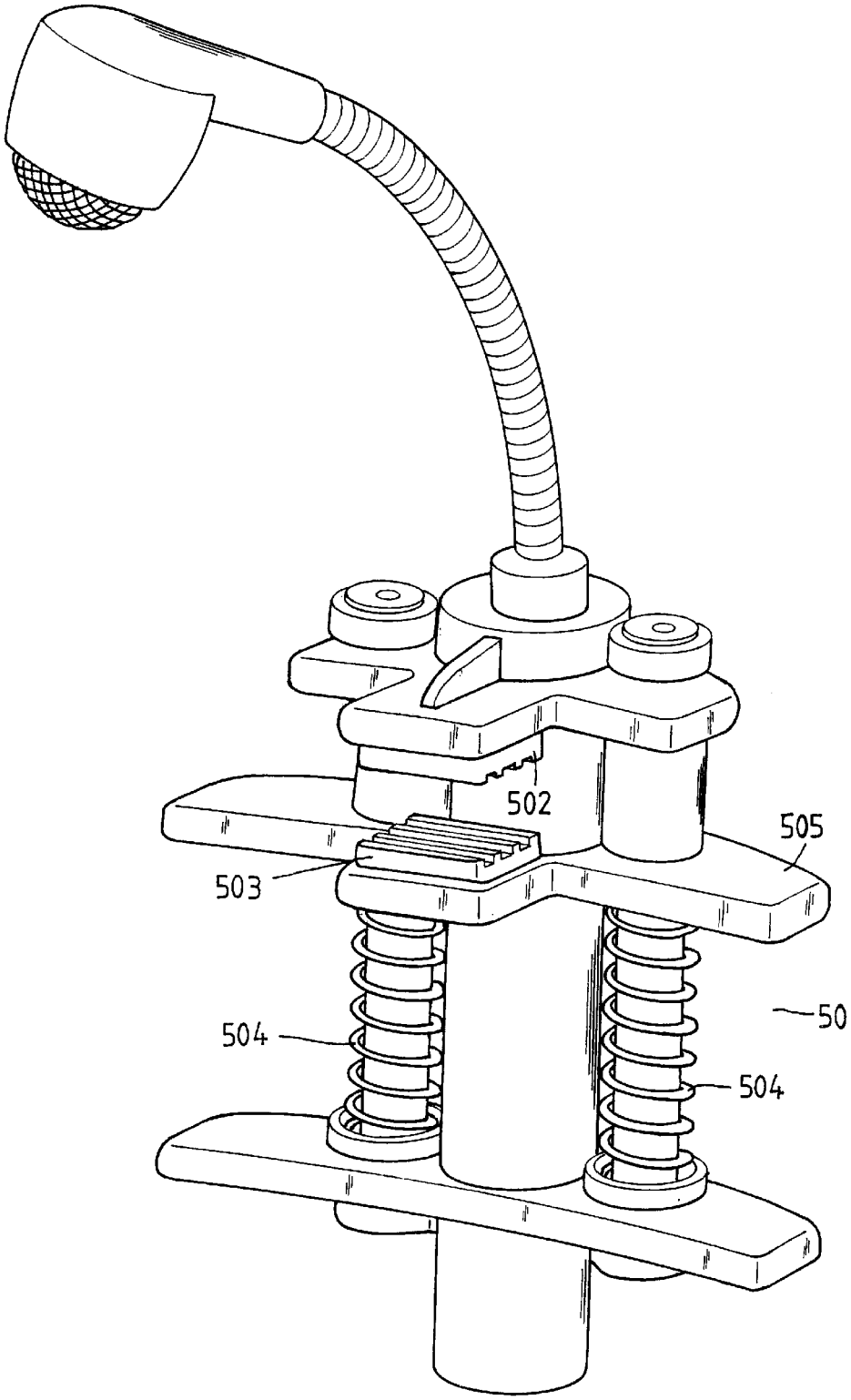
Fig · 5 PRIOR ART

As shown in FIGS. 7–10, a microphone structure embodied in the present invention is used to attach securely a microphone 2 to a percussion instrument 4 or wind instrument 5. The microphone structure comprises a base 1, a locating hole 11, a fixed clamp piece 14, a movable clamp piece 15, and a threaded rod 13.

The locating hole 11 is located at an upper end of the base 1 for locating rotatably a shaft arm 21 of the microphone 2 such that the X-axis position of the microphone head 22 can be adjusted. Located between the microphone head 22 and the shaft arm 21 is a rotary shaft element 23 by which the Y-axis movement of the microphone 2 is made possible. The shaft arm 21 is provided with a connection hole 211 through which the microphone 2 is connected with a wire 3.

The base 1 is provided with a receiving slot 12 of a length and extending from a lower end of the base 1 along the longitudinal direction of the base.

The threaded rod 13 is received in the receiving slot 12 such that a rotating element 131 of the lower end of the threaded rod 13 is jutted out of the open end of the receiving slot 12. The rotating element 131 of the threaded rod 13 of the preferred embodiment of the present invention is a hand grip 131 by which the threaded rod 13 is turned.

The base 1 is further provided in the outer wall of a portion in proximity of the upper end of the base 1 with a fixed clamp piece 14 extending in the direction away from the outer wall of the portion of the upper end of the base 1. The fixed clamp piece 14 is provided with a shock-absorbing pad 16 having a serrated contact surface 161.

The movable clamp piece 15 is provided with a threaded hole 151 and is movably located under the fixed clamp piece 14 such that the threaded hole 151 is engaged with.the threaded rod 13. The movable clamp piece 15 is provided with a shock-absorbing pad 16 having a serrated contact surface 161. The serrated contact surface 161 of the movable clamp piece 15 is opposite to the serrated contact surface 161 of the fixed clamp piece 14. There is a distance between the two contact surface 161, which can be adjusted by turning the threaded rod 13. As the threaded rod 13 is turned with a hand holding the hand grip 131 of the threaded rod 13, the movable clamp piece 15 is actuated to move up or down, thanks to the engagement of the threaded rod 13 with the threaded hole 151 of the movable clamp piece 15.

As shown in FIG. 9, the microphone 2 is fastened securely to the percussion instrument 4 such that a side edge of the percussion instrument 4 is held securely between the fixed clamp piece 14 and the movable clamp piece 15.

As shown in FIG. 10, the microphone 2 is fastened securely to the wind instrument 5 such that the sound tube of the wind instrument is held securely by the fixed clamp piece 14 and the movable clamp piece 15.

The microphone structure of the present invention is designed to attach a microphone to a musical instrument without the assistance of a hand tool. The microphone structure of the present invention is applicable to a variety of musical instruments, such as side drum, base drum, flute, saxophone, etc.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

What is claimed is:

1. A microphone structure comprising a base whereby said base is provided at an upper end with a locating hole for locating adjustably a microphone, in an interior with a receiving slot of a length and extending from a lower end of said base along the longitudinal direction of said base, in an outer wall of a portion in proximity of the upper end of said base with a fixed clamp piece, a movable clamp piece located movably under said fixed clamp piece and provided with a threaded hole in communication with said receiving slot, and a threaded rod rotatably received in said receiving slot such that said threaded rod is engaged with said threaded hole of said movable clamp piece, and that said threaded rod is turned to-drive said movable clamp piece to move up or down for adjusting a distance between said fixed clamp piece and said movable clamp piece.

2. The microphone structure as defined in claim 1, wherein said fixed clamp piece is provided with a shock-absorbing contact surface; wherein said movable clamp piece is provided with a shock-absorbing contact surface opposite to said shock-absorbing contact surface of said fixed clamp piece.

3. The microphone structure as defined in claim 2, wherein said shock-absorbing contact surfaces of said movable clamp piece and said fixed clamp piece are serrated.

4. The microphone structure as defined in claim 1, wherein said threaded rod is provided at a lower end with a rotating element fastened therewith such that said rotating element is jutted out of the lower end of said base.

5. The microphone structure as defined in claim 4, wherein said rotating element is a hand grip.

* * * * *